US008529085B2

(12) United States Patent
Josefowicz et al.

(10) Patent No.: US 8,529,085 B2
(45) Date of Patent: Sep. 10, 2013

(54) LIGHT EMITTING DIODE (LED) ROADWAY LIGHTING FIXTURE

(75) Inventors: Jack Yitzhak Josefowicz, Halibut Bay (CA); Matthew Francis Durdle, Dartmouth (CA); Charles Andrew Cartmill, Halifax (CA)

(73) Assignee: LED Roadway Lighting Ltd., Halifax, Nova Scotia (CA)

( * ) Notice: Subject to any disclaimer, the term of this patent is extended or adjusted under 35 U.S.C. 154(b) by 301 days.

(21) Appl. No.: 13/063,823

(22) PCT Filed: Sep. 15, 2009

(86) PCT No.: PCT/CA2009/001283

§ 371 (c)(1),
(2), (4) Date: Apr. 19, 2011

(87) PCT Pub. No.: WO2010/028509

PCT Pub. Date: Mar. 18, 2010

(65) Prior Publication Data

US 2011/0188233 A1 Aug. 4, 2011

Related U.S. Application Data

(60) Provisional application No. 61/097,216, filed on Sep. 15, 2008, provisional application No. 61/097,211, filed on Sep. 15, 2008, provisional application No. 61/238,348, filed on Aug. 31, 2009.

(51) Int. Cl.
*F21L 4/02* (2006.01)
*F21S 4/00* (2006.01)

(52) U.S. Cl.
USPC ..... 362/158; 362/235; 362/240; 362/249.02; 362/294; 362/431

(58) Field of Classification Search
USPC ..... 362/158, 235, 240, 249.02, 294, 362/431
See application file for complete search history.

(56) References Cited

U.S. PATENT DOCUMENTS 6,250,774 B1 6/2001 Begemann et al.
6,543,911 B1 4/2003 Rizkin et al.

(Continued)

FOREIGN PATENT DOCUMENTS

CN 1811266 A 8/2006
CN 101101098 A 1/2008

(Continued)

OTHER PUBLICATIONS

Athina Nickitas-Etienne; International Preliminary Report on Patentability; International Application No. PCT/CA2009/001283; Mar. 24, 2011; International Bureau of WIPO; Geneva Switzerland.

(Continued)

*Primary Examiner* — Stephen F Husar
*Assistant Examiner* — James Cranson, Jr.
(74) *Attorney, Agent, or Firm* — Stevens & Showalter LLP

(57) ABSTRACT

A light emitting diode (LED) lighting roadway lighting fixture and housing is provided. The lighting fixture comprises a center section enclosing a power supply for the LEDs. Two LED sections are positioned on either side of the center section and angled towards the center of the lighting fixture and the plane to be illuminated. LED engines are mounted on the LED sections to illuminate the plane.

28 Claims, 20 Drawing Sheets

(56) References Cited

U.S. PATENT DOCUMENTS

| | | | | |
|---|---|---|---|---|
| 6,739,738 | B1 | 5/2004 | Smith | |
| 6,816,389 | B1 | 11/2004 | Lutz et al. | |
| 6,902,291 | B2 | 6/2005 | Rizkin et al. | |
| 7,278,761 | B2 * | 10/2007 | Kuan | 362/294 |
| 7,641,363 | B1 * | 1/2010 | Chang et al. | 362/294 |
| 7,651,245 | B2 | 1/2010 | Thomas et al. | |
| 7,665,862 | B2 | 2/2010 | Villard | |
| 7,766,508 | B2 | 8/2010 | Villard et al. | |
| 7,771,087 | B2 * | 8/2010 | Wilcox et al. | 362/294 |
| 7,810,963 | B2 | 10/2010 | Peck | |
| 7,832,898 | B2 * | 11/2010 | Li | 362/249.02 |
| 7,922,372 | B2 * | 4/2011 | Li | 362/373 |
| 7,959,331 | B2 * | 6/2011 | Ho | 362/373 |
| 7,993,039 | B2 | 8/2011 | Nankil et al. | |
| 8,113,687 | B2 | 2/2012 | Villard et al. | |
| 8,220,961 | B2 | 7/2012 | Belknap et al. | |
| 8,267,544 | B2 * | 9/2012 | Zheng et al. | 362/249.02 |
| 8,376,582 | B2 * | 2/2013 | Catone et al. | 362/249.03 |
| 8,408,739 | B2 * | 4/2013 | Villard et al. | 362/249.02 |
| 2007/0030676 | A1 | 2/2007 | Ichihara | |
| 2008/0062691 | A1 | 3/2008 | Villard et al. | |
| 2009/0034255 | A1 | 2/2009 | Li | |
| 2011/0194281 | A1 * | 8/2011 | Josefowicz et al. | 362/235 |
| 2011/0210676 | A1 | 9/2011 | Beghelli | |
| 2012/0025711 | A1 | 2/2012 | Best et al. | |

FOREIGN PATENT DOCUMENTS

| | | | |
|---|---|---|---|
| CN | 101105278 | A | 1/2008 |
| CN | 101230962 | A | 7/2008 |
| CN | 201187734 | Y | 1/2009 |
| EP | 1400747 | A2 | 3/2004 |
| EP | 1988576 | A1 | 3/2008 |
| EP | 1956290 | A1 | 8/2008 |
| EP | 2020564 | A1 | 2/2009 |
| GB | 2439745 | A | 7/2006 |
| JP | 2004303614 | A | 10/2004 |
| WO | 9833007 | | 7/1998 |
| WO | 03048637 | A1 | 6/2003 |
| WO | 2006060905 | A1 | 6/2006 |
| WO | 2009104067 | A1 | 8/2009 |

OTHER PUBLICATIONS

Athina Nickitas-Etienne; International Preliminary Report on Patentability; International Application No. PCT/CA2009/001279; Mar. 24, 2011; International Bureau of WIPO; Geneva Switzerland.

Office Action; Chinese Application No. 200980145528.5; Aug. 24, 2012; State Intellectual Property Office of P.R.C.

Amerongen, Wim; Extended European Search Report for European Application No. 09812588.3 (PCT/CA2009001279); May 30, 2012.

Amerongen, Wim; Extended European Search Report for European Application No. 09812592.5 (PCT/CA2009001283); May 22, 2012.

Alan Jones; International Search Report for International application No. PCT/CA2009/001283; Dec. 10, 2009; Gatineau, Quebec.

Malgorzata Samborski; International Search Report for International application No. PCT/CA2009/001279; Dec. 23, 2009; Gatineau, Quebec.

U.S. Appl. No. 13/063,831, filed Mar. 14, 2011 which is the national stage entry of PCT/CA2009/001279 filed Sep. 15, 2009.

Office Action; Mexican National Phase Application No. MX/a/2011/002801; Feb. 16, 2012.

English machine translation of CN201187734; Chuntao Zhang; published Jan. 28, 2009.

Walford, Natalie K.; Non-final Office Action in U.S. Appl. No. 13/063,831; Feb. 7, 2013; U.S. Patent and Trademark Office; Alexandria, VA; 18 pages.

* cited by examiner

LIGHT EMITTING DIODE (LED) ROADWAY LIGHTING FIXTURE

CROSS-REFERENCE TO RELATED APPLICATIONS

This application claims priority from U.S. Provisional Application No. 61/097,216 filed Sep. 15, 2008, U.S. Provisional Application No. 61/097,211 filed Sep. 15, 2008 and U.S. Provisional Application No. 61/238,348 filed on Aug. 31, 2009, the contents of which are hereby incorporated by reference.

TECHNICAL FIELD

The present disclosure relates to light emitting diode (LED) lighting fixtures and in particular to an LED lighting fixture for roadway illumination.

BACKGROUND

Exterior lighting is used to illuminate roadways, parking lots, yards, sidewalks, public meeting areas, signs, work sites, and buildings commonly using high-intensity discharge lamps, often high pressure sodium lamps (HPS). The move towards improved energy efficiency has brought to the forefront light emitting diode (LED) technologies as an alternative to HPS lighting in commercial or municipal applications. LED lighting has the potential to provide improved energy efficiency and improved light output in out door applications however in a commonly used Cobra Head type light fixture the move to include LED lights has been difficult due to heat requirements and light output and pattern performance. There is therefore a need for an improved LED light fixture for outdoor applications.

SUMMARY

An exterior lighting fixture for positioning a plurality of light emitting diodes (LEDs) above an illumination plane is provided. The lighting fixture comprises a housing having a longitudinal axis. The housing comprises a center section arranged about a longitudinal center line of the housing and running substantially along an entire length of the longitudinal axis of the housing, the center section defining a compartment enclosing at least one light emitting diode (LED) power supply; a first LED section arranged on a first side of the center section and running substantially along the entire length of the longitudinal axis of the housing, the first LED section defining a first sealable LED compartment and a first mounting surface for mounting a first LED engine to the first LED section, the first mounting surface directed towards the longitudinal center line of the housing and the illumination plane; a second LED section arranged on a second side of the center section opposite the first side and running substantially along the entire length of the longitudinal axis of the housing, the second LED section defining a second sealable LED compartment and a second mounting surface for mounting a second LED engine to the second LED section, the second mounting surface directed towards the center line of the housing and the illumination plane; a first passageway connecting the sealable center compartment with the first sealable LED compartment; and a second passageway connecting the sealable center compartment with the second sealable LED compartment. The first LED engine is mounted on the first mounting surface of the first LED section, the LED engine electrically connected to the LED power supply with an electrical cable passing through the first passageway, the first LED engine comprising a plurality of LEDs fixed to a printed circuit board for illuminating a side of the illumination plane opposite the first LED section; and the second LED engine is mounted on the second mounting surface of the second LED, the LED engine electrically connected to the LED power supply with an electrical cable passing through the second passageway, the second LED engine comprising a plurality of LEDs fixed to a printed circuit board and illuminating a second side of the illumination plane opposite the second LED section.

A housing for an exterior lighting fixture for positioning a plurality of light emitting diodes above an illumination plane is also provided. The housing comprises a center section arranged about a center line of the housing and running substantially along an entire length of a longitudinal axis of the housing, the center section defining a sealable center compartment for enclosing a light emitting diode (LED) power supply; and first and second LED sections, each of the LED sections located on opposite sides of the center section and running substantially along the entire length of the longitudinal axis of the housing, each of first and second LED sections defining a respective sealable compartment and a mounting surface for mounting an LED engine to the respective LED section covering the sealable compartment, the mounting surface of each respective LED section directed towards the center line of the housing and the illumination plane.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Embodiments are described below, by way of example only, with reference to FIGS. 1-23.

Traditional Cobra Head lighting fixtures used in HPS lighting systems have presented problems in term of heat dissipation and light output and pattern performance when attempting to switch to an LED light fixture. As a result, Cobra head fixtures with LEDs have presented a sub-optimal replacement for existing HPS lighting systems. To overcome these issues an improved fixture design is provided.

LED lights require electronics to control their operation, during the lifetime of these electronics they may degrade, or become unstable, if they operate in an environment with a temperature outside of an operating range of temperatures suitable for the electronics. In addition to the correct operation of these electronics, the operating life of LEDs may be effected by the temperature in which they operate. This is in contrast to HPS lights, which can operate properly within a much wider range of operating temperatures.

In order to provide an LED light fixture suitable for exterior applications, the light fixture should manage the thermal output of the LED lights. In addition to the thermal management, the lighting fixture should also ensure that the light fixture provides a sufficient amount of light in an appropriate pattern to meet the lighting requirements.

Figure 1:
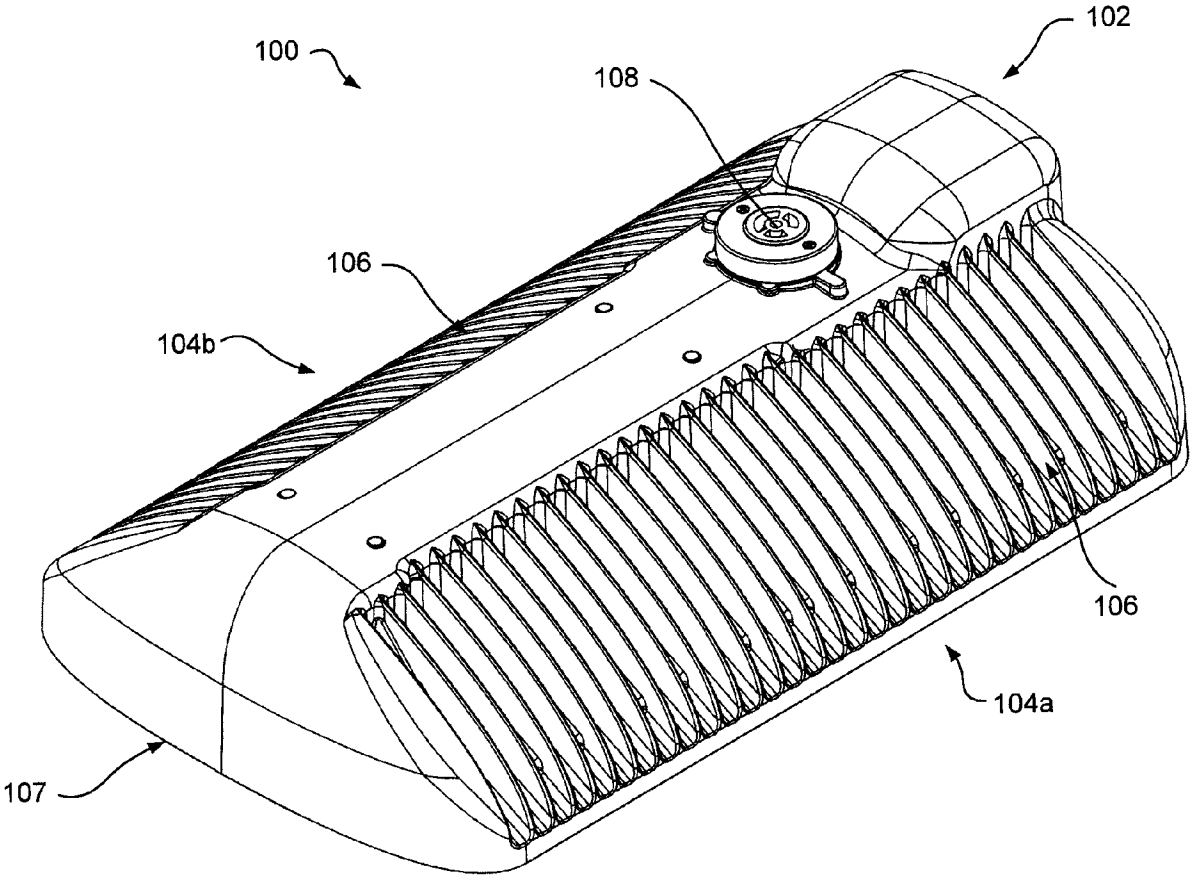
FIG. 1 is a perspective view of an improved LED light fixture head compatible with Cobra head mounts.
Figure 3:
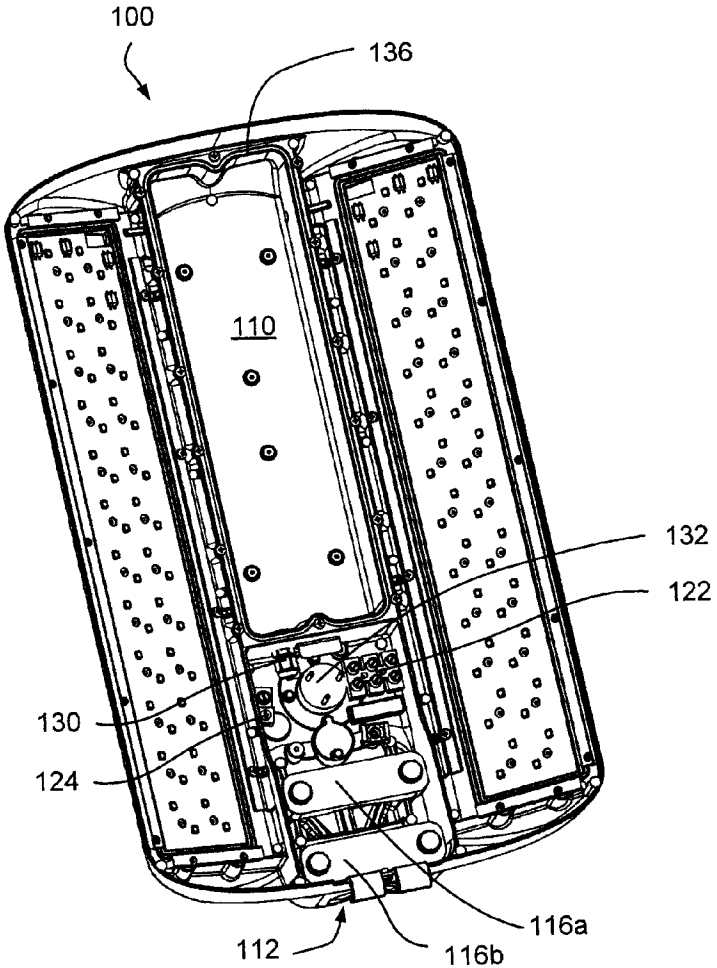
FIG. 3 is a bottom view of LED light fixture showing front and rear sections.

As shown in FIG. 1, an improved exterior light fixture 100 for LED lights is provided. The exterior light fixture 100 is compatible with Cobra head mounts. The light fixture 100 provides the required optics and thermal performance so that the LED light fixture 100 may be used for illuminating roadways according to Type II Institute of Lighting Engineers (IES) light distribution requirements. The light fixture 100 design, including the angles of the LED light engines (i.e., PCB boards with the LEDs assembled on them), can meet IES Type II light distribution requirements for lighting a roadway. In addition to the constraints required to provide proper illumination, the design of the light fixture 100 is further dictated by the thermal requirements and helps ensure that the heat produced by the LEDs of the LED light engines is dissipated sufficiently to provide proper operation of the LEDs.

Figure 2:
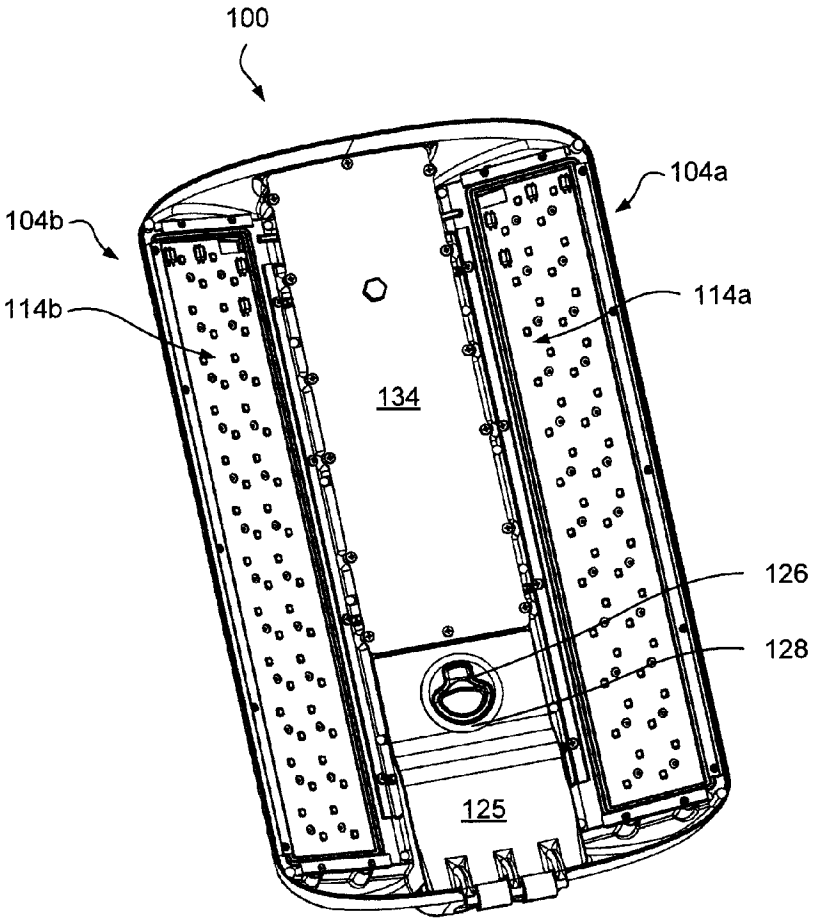
FIG. 2 is a bottom view of LED light fixture showing LED engine sections.

The light fixture 100 has two LED engines 114*a*, 114*b*, one on either side of a center section 102 of the light fixture 100 as shown in FIG. 2. Splitting the light source into two LED sections 114*a*, 114*b* allows the heat that is given off from the LED's to be dispersed between two sections. This helps to reduce the thermal degradation to the LED's. By splitting the LED's into two LED sections, each consisting of half the amount of LED's of the whole fixture, the amount of cross heating of LED's from neighbouring LED's is also reduced, further improving the thermal characteristics of the lighting fixture 100. The two LED sections 114*a*, 114*b* are separated by the center section 102 of the light fixture 100. The exterior of the center section 102 may have a top surface that has an arcuate cross-section. The interior of the center section 102 houses the electronics, including the power supply for the LEDs. The center section 102 may include a sealable front section 110 for enclosing the electronics. The sealable front section 110 may be sealed by a cover plate 134 that is fixed to the light fixture 100 using, for example, screws or bolts. The center section 102 may further include a rear section 112 that encloses a pole mount area and electrical connection area as shown in further detail in FIG. 3. The rear section 112 may be covered by a hinged door 125.

The light fixture 100 described may comprise a one piece cast fixture housing including the rear section 112 for the pole mounting and mains power line connections. The rear section 112 may be covered by a hinged door 125. The light fixture housing features two cast hooks that are used with a bar on the hinged door 125. This type of hinge is very robust and makes the door easily removable. It also simplifies manufacturing because there is no hinge pin that is needed to be installed.

The one piece cast light fixture housing creates a very robust light fixture 100 that can withstand more rough handling and conditions versus a light fixture that is made from many different components such as extrusions that are bolted together. The material used for the one piece cast light fixture housing may be die cast aluminium including, for example, aluminium grades A380, A360, A383, A413, K-alloy etc.

By separating the pole mounting and mains power line connections from the LED driver section, the LED drivers/power supply are able to be mounted in a separate sealed front section 110, whereas previous cobra head light fixtures had pole mount, line connection and ballast all in an unsealed compartment. By having the hinged door 125 covering the pole mount/line connection area of the rear section 112 it can be accessed separately from the sealed front section 110, for installation/removal and maintenance while the rest of the light fixture 100 is left sealed. The other advantage of having a sealed front compartment 110 is that the drivers do not need a separate enclosure to protect them from the environment which saves on cost and complexity of those components.

Figure 5:
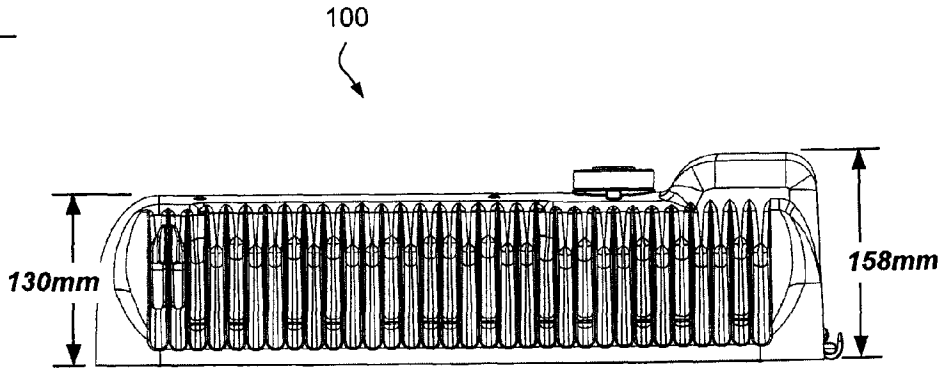
FIG. 5 is left side view of the LED light fixture.
Figure 4:
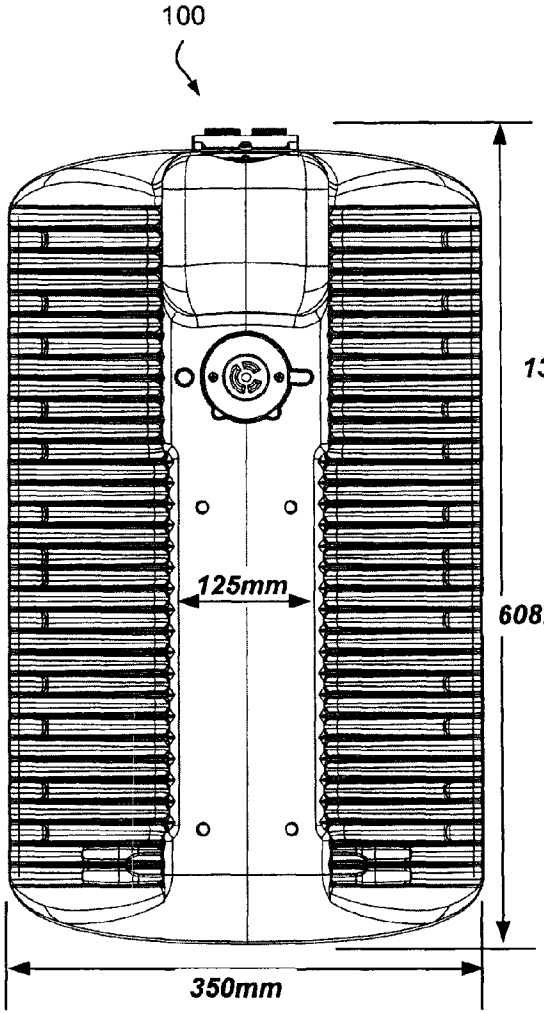
FIG. 4 is top view of the LED light fixture.

As shown in FIGS. 4 and 5, the light fixture 100 can have outside dimensions of approximately 608 mm in length, 350 mm in width, and 158 mm in height. The light fixture may have a center section of 125 mm in width. The height of the light fixture 100 may be 130 mm in the lower section in front of the pole mount area.

Figure 6B:
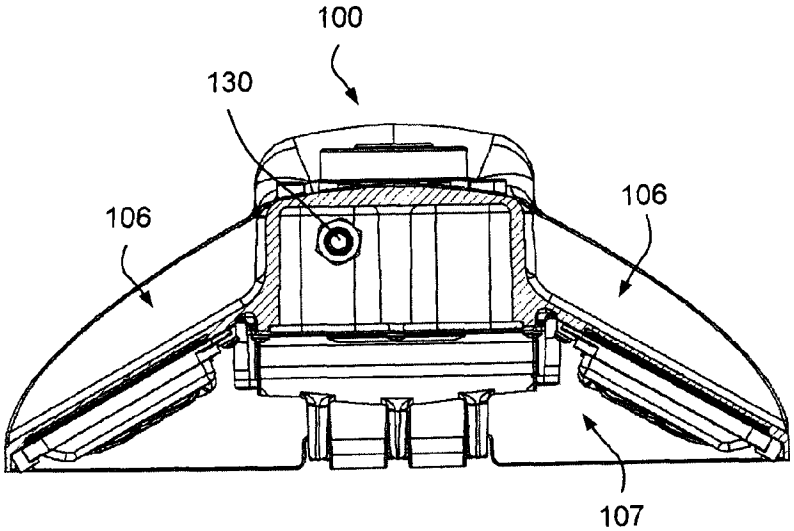
FIG. 6B is a cross-section view of the LED light fixture.
Figure 6A:
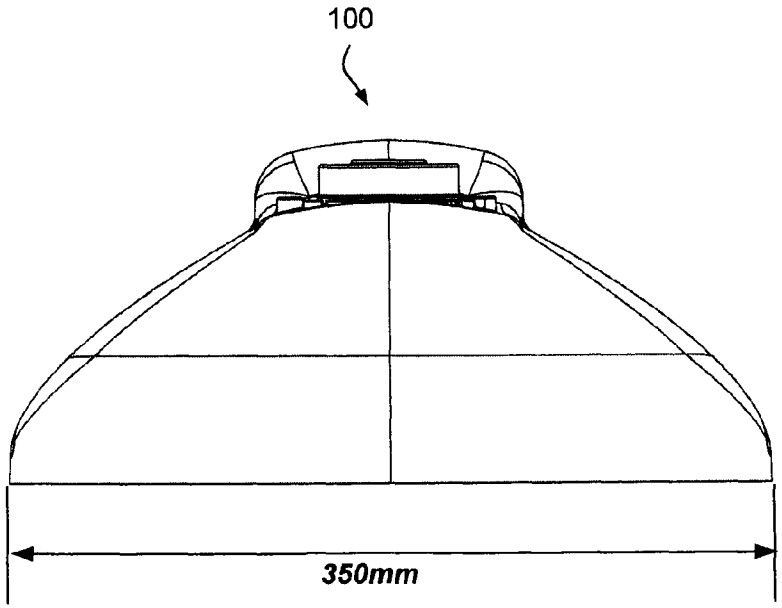
FIG. 6A is a front view of the LED light fixture.

As shown in FIGS. 6A & 6B the top surface of the exterior of the light fixture may be convex in shape. The interior of the light fixture 100 may be concave in shape. The concavity of the underside of the fixture protects the optical components from direct access by any elements falling from above or in the horizontal direction. A canopy 107 that runs around the periphery of the light fixture 100 also blocks any up light which reduces light pollution into the night sky.

Figure 7:
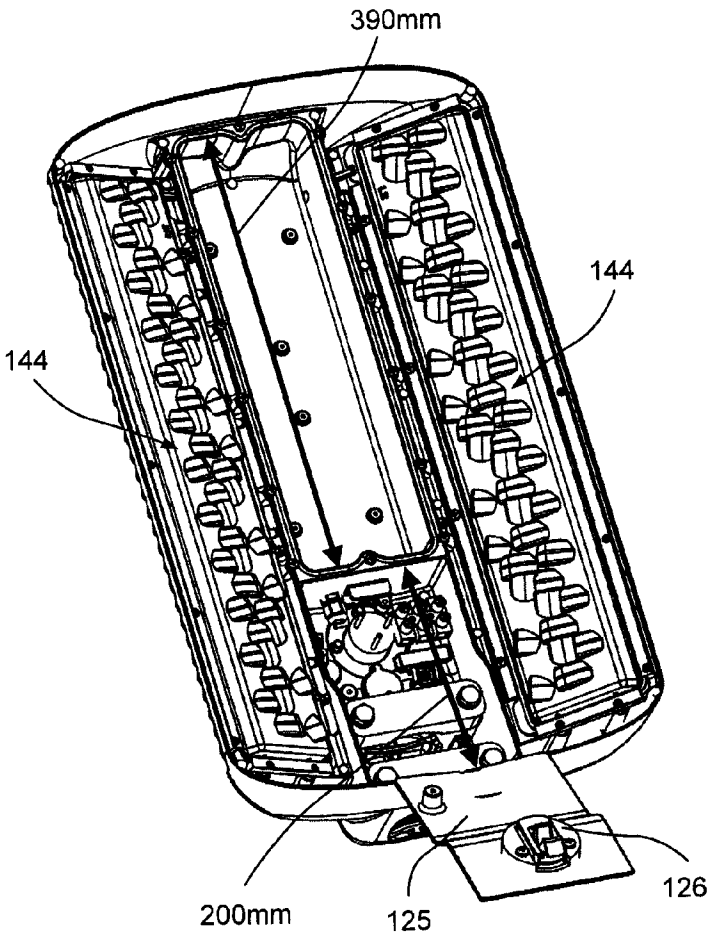
FIG. 7 is a bottom view of the LED light fixture.

The front section 110 holds the LED power supplies (drivers) and is about 390 mm in length. The rear section 112 is about 200 mm in length as shown more clearly in FIG. 18*a*-18*c*. As shown in FIG. 7 the rear section 112 contains a pole mount comprising two pole mount clamps 116*a*, 116*b*, including pole mount bolts, the pole mount features of the casting, including angle stop ribs 120*a*,120*b* and pivot rib 118. A terminal block 122 is provided, where the incoming mains power line wires are connected to the light fixture 100, a ground lug 124 where the incoming ground wire is connected. The hinged door 125 covering the rear section 112 may be latched by a door latch 126 and door latch keeper 128. The rear section 112 can include a passageway 130 through to the front section 110. This passageway 130 allows an electrical connection to be made between the terminal lug 122 in the rear section 112 and the power supplies/LED drivers in the sealable front section 110. This passageway 130 may comprise a gasket or other suitable means for sealing the passageway 130 once the wire connections are made. This allows the electrical wires to pass between the rear section 112 and the front section 110 while maintaining the seal of the front section 110. The rear section 112 can include a photocell receptacle 132 for receiving a photocell 108, which may be used to detect the ambient light of the environment and control the operation of the light fixture. The light fixture 100 may also include the associated fasteners used to fasten each component to the light fixture 100.

Figure 8:
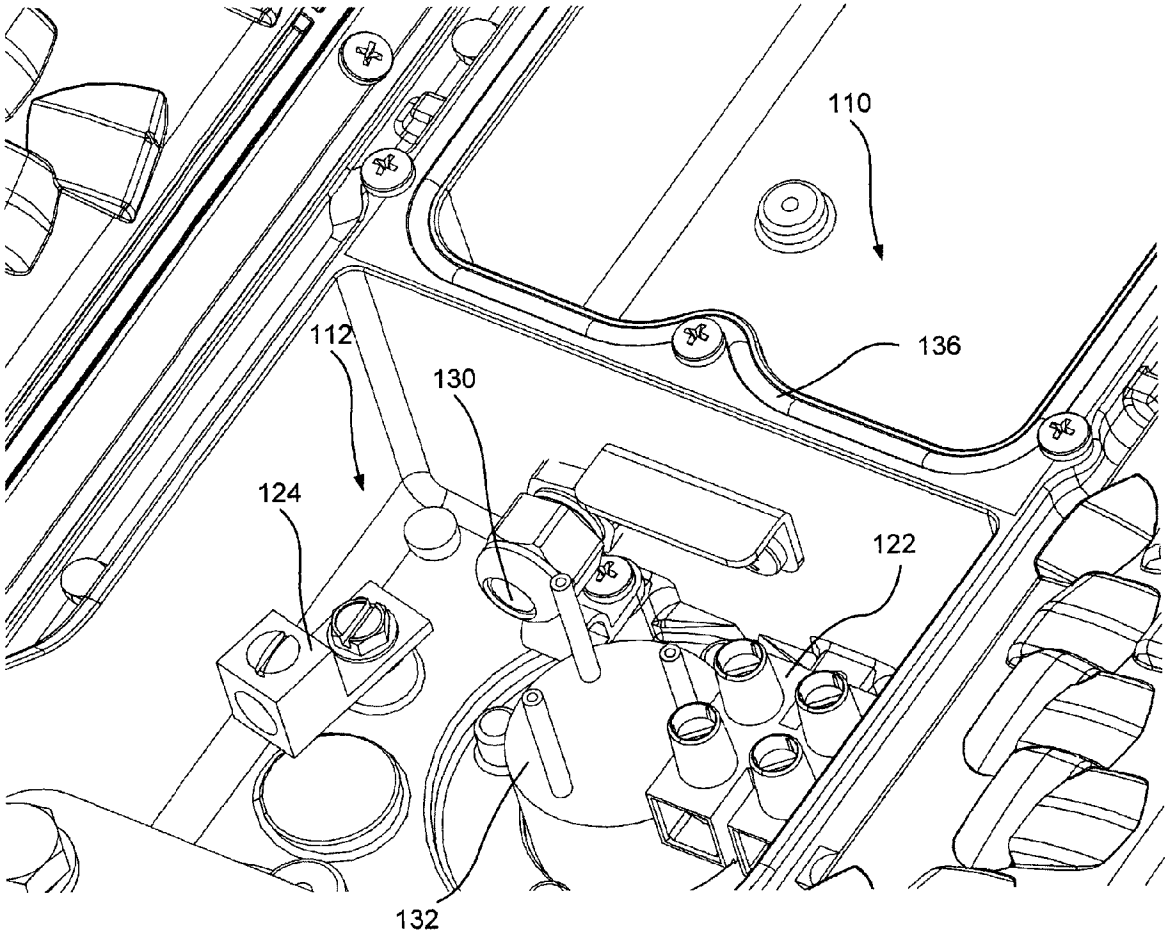
FIG. 8 is detailed view of the rear section of the LED light fixture.
Figure 9:
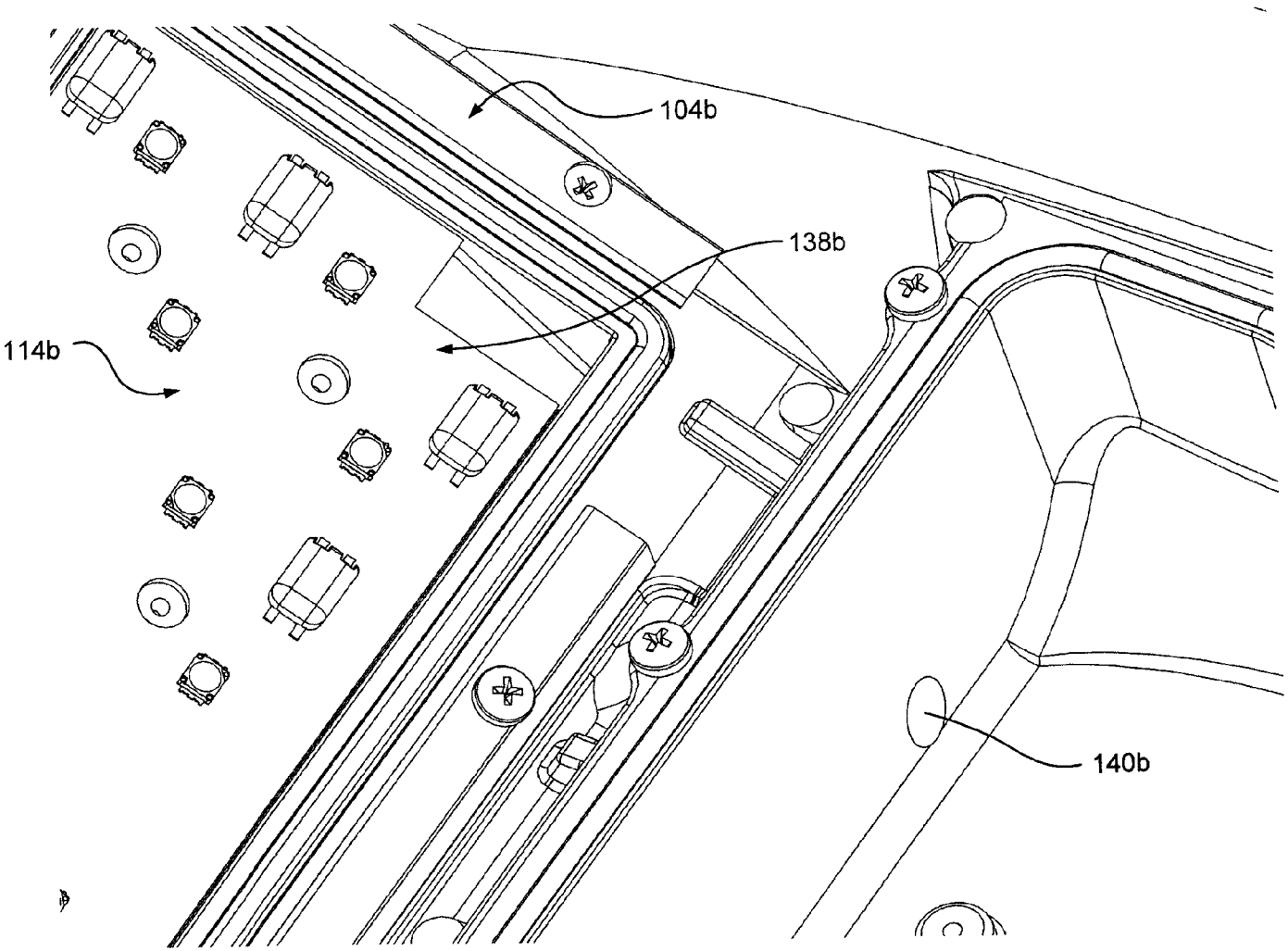
FIG. 9 is a detailed view of the access between the LED engine and power supply.
Figure 10:
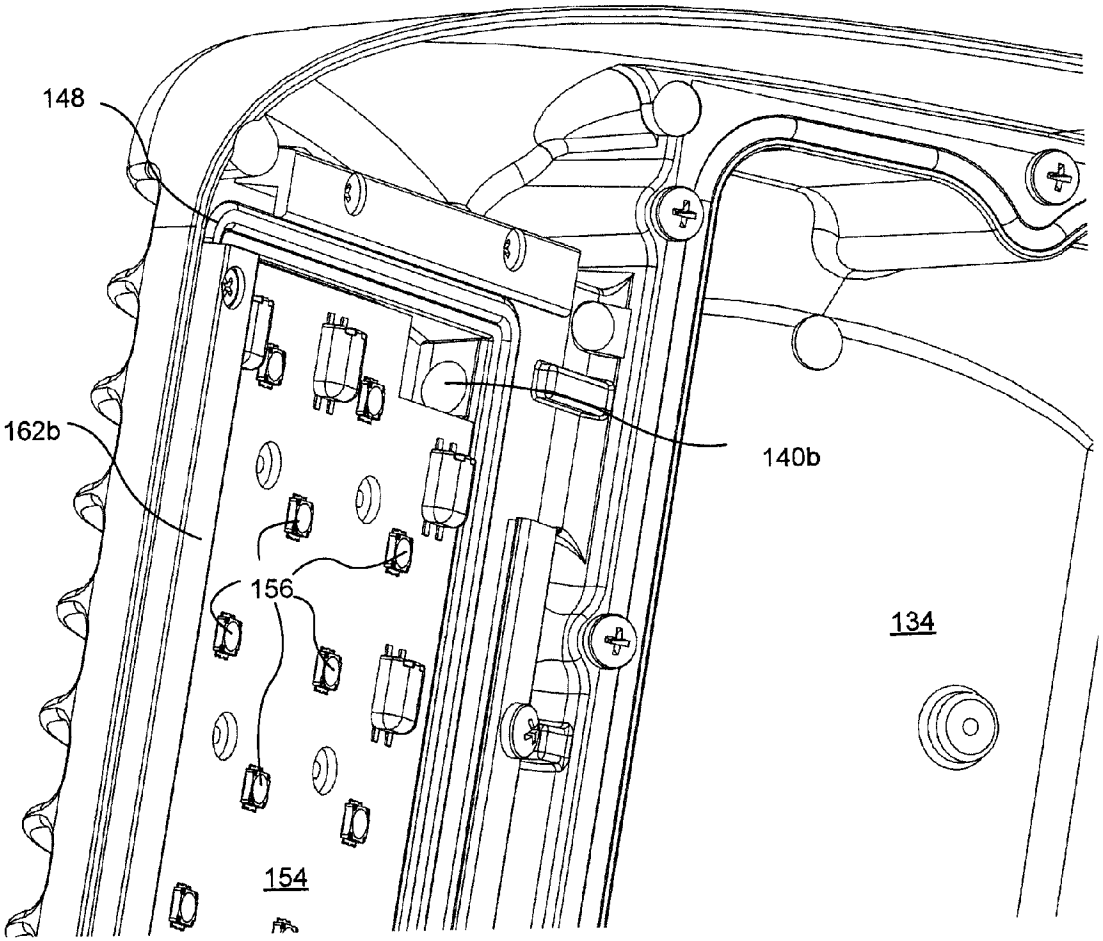
FIG. 10 is a second detailed view of the access between the LED engine and power supply.

As shown in FIG. 8, the front section may be sealed with an O-ring 136 that is compressed between the light fixture 110 housing and a cover plate 134 to ensure a water tight seal. As shown in FIGS. 9 and 10 there are passageways 140*a*, 140*b* that pass from each side of the front compartment 110 to the sealed LED compartments 138*a*, 138*b* on the LED sections 104*a*, 104*b* of the light fixture 100. These passageways 140*a*, 140*b* allow electrical connections to be made between the LED power supplies and the LED engines 114*a*, 114*b* while maintaining the seal of the compartments to the exterior elements.

The LED sections 104*a*, 104*b* of the light fixture are positioned on either side of the center section 102. Each of the LED sections 104*a*, 104*b* define a LED compartment 138*a*, 138*b* and a mounting surface 142*a*, 142*b*. The LED compartments 138*a*, 138*b* may be formed, or defined, by a shallow depression in the respective LED section 104*a*, 104*b*. The bottom of the LED compartments 138*a*, 138*b* may provide a flat surface to act as the respective mounting surfaces 142*a*, 142*b*. The LED compartments 138*a*, 138*b* receive the LED engines 114*a*, 114*b*. The LED sections 104*a*, 104*b* and the respective mounting surfaces 142*a*, 142*b* are arranged such that the LED engines 114*a*, 114*b* once mounted are directed at an angle towards the center of the light fixture and down towards the surface being illuminated.

Figure 11:
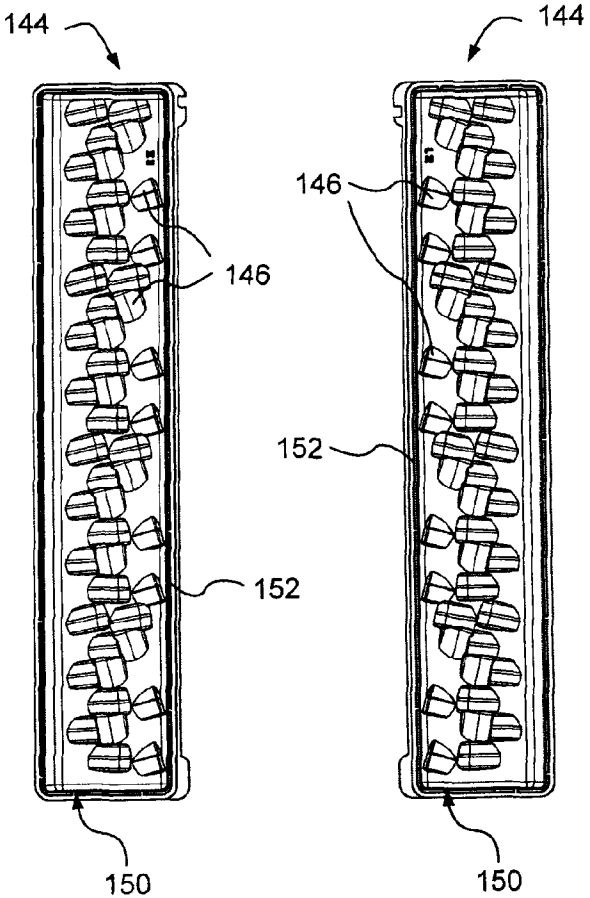
FIG. 11 is LED lens cover.
Figure 12:
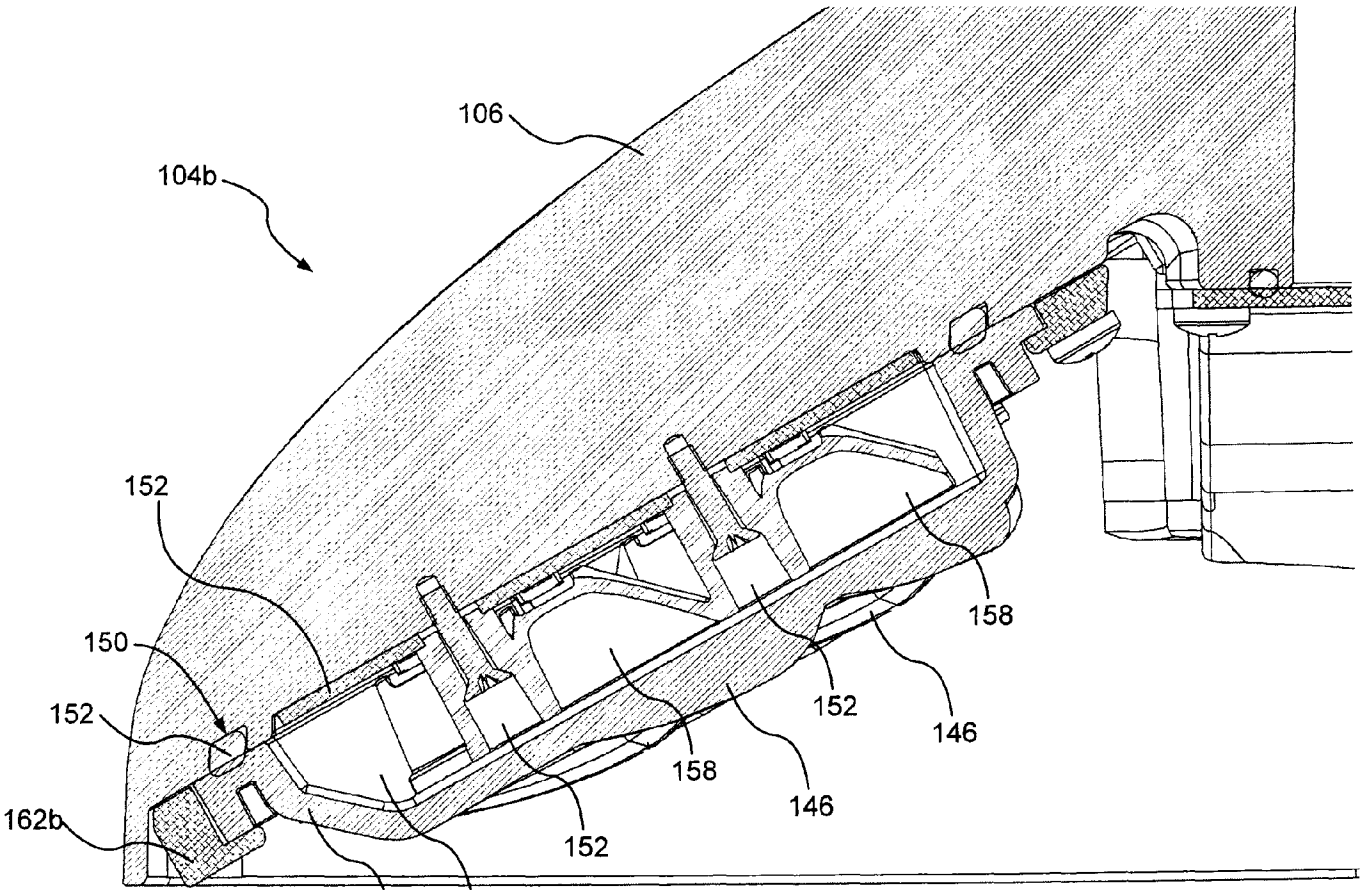
FIG. 12 is a cross-sectional view of LED engine section.
Figure 13:
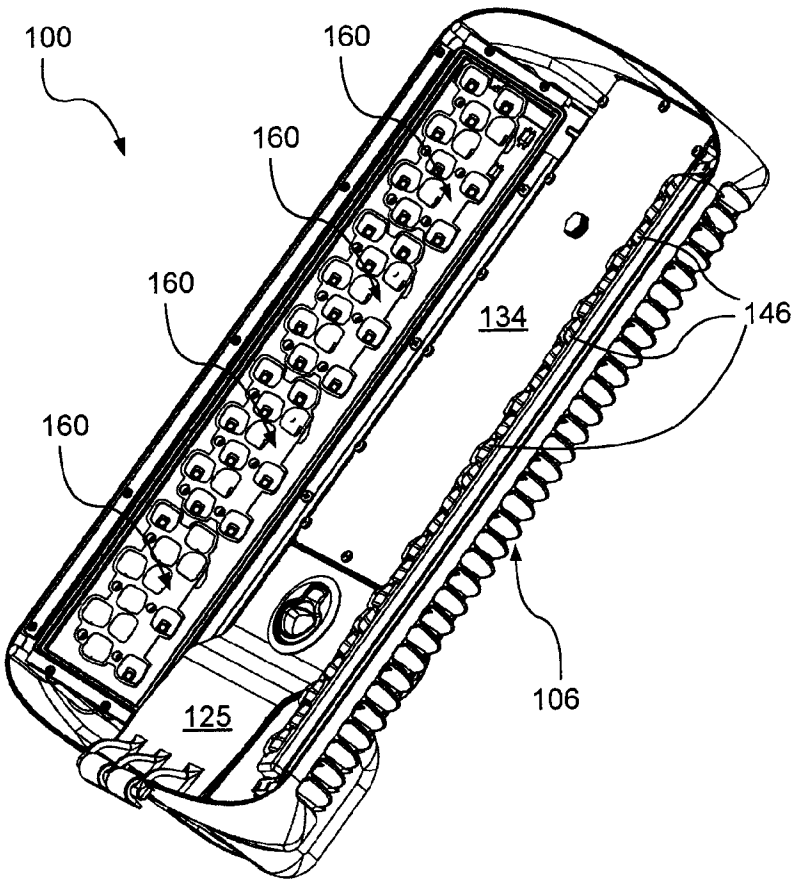
FIG. 13 is a perspective view of the LED light fixture.

There is a cover lens 144 as shown in FIG. 11 that contains optical elements 146 for creating the desired illumination pattern. The cover lens 144 is made of high impact plastic or glass. As shown in FIG. 10, there is a rib 148 that runs around the periphery of the LED compartment 138*a*, 138*b* of the LED sections 104*a*, 104*b* where the LED engines 114*a*, 114*b* are mounted. This rib 148 fits into a groove 150 on the cover lens 144 that locates the cover lens 144 over the LED compartment 138*a*, 138*b*. Between the cover lens 144 and the light fixture housing, an O-ring 152 seal is compressed to ensure a water tight seal. The O-ring 152 seal is compressed between the rib 148 and the cover lens 144 itself. Each cover lens 144 is fastened to the light fixture 100 using mounting brackets 162*a*, 162*b* that follow the outside edge of the lens cover 144 in the direction parallel to the length of the light fixture 100. Contained inside the LED compartments 138*a*, 138*b* of the light fixture housing and covered by the cover lens 144 are the LED engines 114*a*, 114*b*. Each of the LED engines 114*a*, 114*b* include the circuit boards 154, the LEDs 156, the LED circuit board wire connectors and the LED reflectors 158 as well as associated fasteners. The circuit board 154 provides a plurality of LEDs 156 in a modular configuration for use with one or more modular LED reflector modules 160. A plurality of LED reflector modules 160 may be used to provide the LEDs 156 in the LED sections 104*a*, 104*b*.

The LED engines 114*a*, 114*b* may be formed from a plurality of LED reflector modules. Each LED reflector module 160 may associated with a number of LEDs, such as for example six or twelve LEDs each individually surrounded by a reflector 158. The twelve LED reflector module 160 provides for modularity shown in FIG. 13. By making the LED engines 114*a*, 114*b* modular additional output can be added without needing to redesign the LED sections 104*a*, 104*b* or other components of the light fixture. For example, each LED section 104*a*, 104*b* can accommodate four blocks of 12 LEDs, or more depending on the overall design, to enable flexibility in determining light output of the fixture. The blocks can be populated and turned on as required. Alternatively, each LED section 104*a*, 104*b* may be a multiple of 6 LEDs based upon light output requirements.

To help dissipate the heat from the LED engines 114*a*, 114*b*, in addition to splitting them in two sections, the light fixture 100 includes a plurality of cooling fins 106 on the exterior side of the LED sections 104*a*, 104*b*, that is the exterior side of the LED sections opposite the LED compartment and mounting surface 142*a*, 142*b*. The cooling fins 106 are in thermal communication with the LED engines 114*a*, 114*b* to help dissipate the heat.

Figure 14:
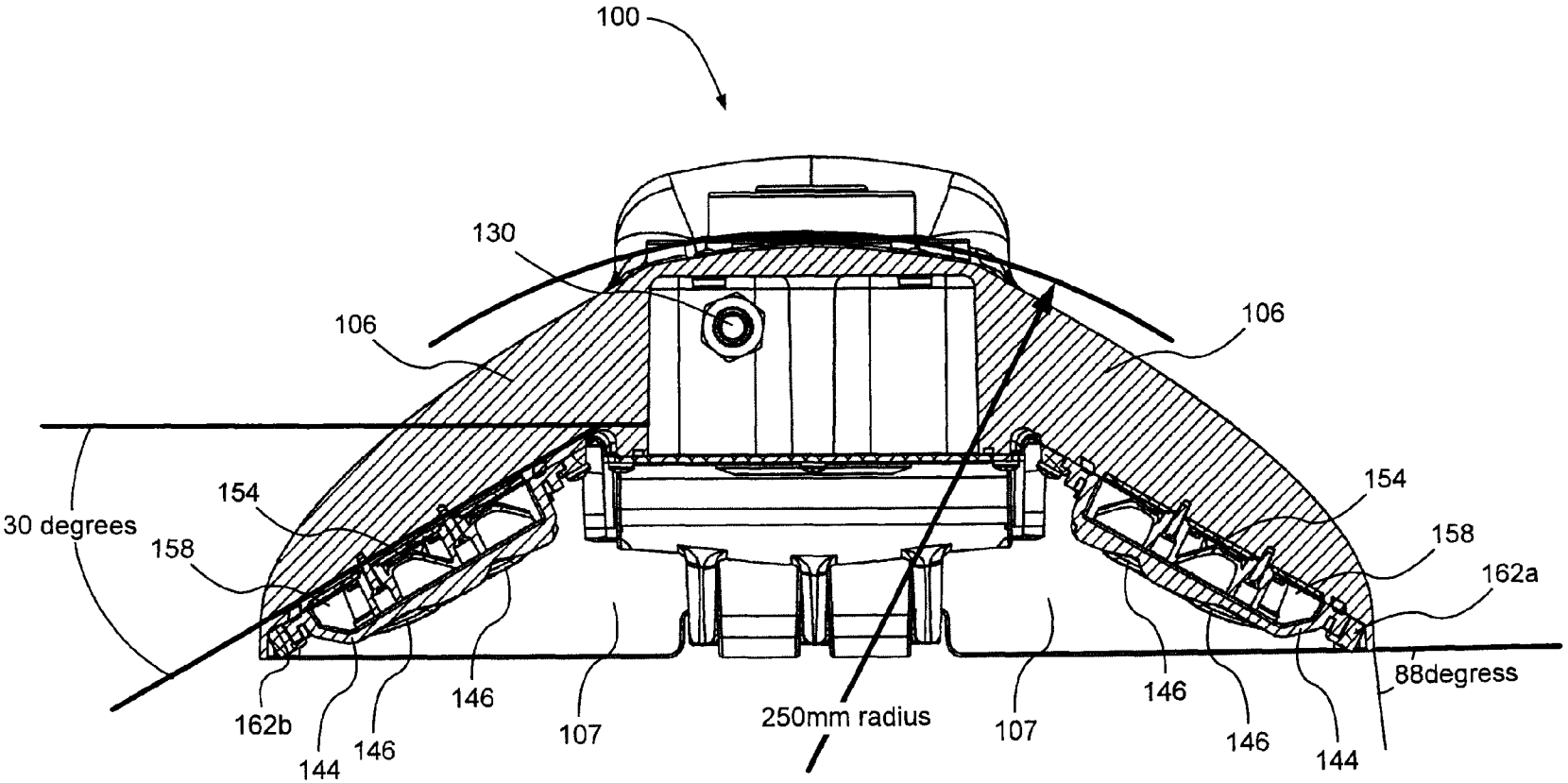
FIG. 14 is a cross-sectional view of LED light fixture.

As shown in FIG. 14, the light fixture housing has a rounded top profile to prevent, or limit, debris from gathering on top of the light fixture 100. The center section 110 of the light fixture 100 has a curvature of approximately 250 mm in radius. This curvature helps to prevent water from pooling on the top of the light fixture 100 and help prevent debris from becoming caught up on the light fixture 100. On the outboard side of the LED sections of the fixture, the surfaces in between the cooling fins 106 are angled downward at 30 degrees. This promotes evacuation of water and debris from between the cooling fins 106. The top profile of the cooling fins 106 are curved and angle downward 30 degrees where it joins to the center section 102 of the light fixture housing. The top of the cooling fin continues to slope downward at a greater angle towards the outboard sides of the respective LED section 104*a*, 104*b* of the light fixture 100 where it angles downward at an 88 degree angle.

Figure 23:
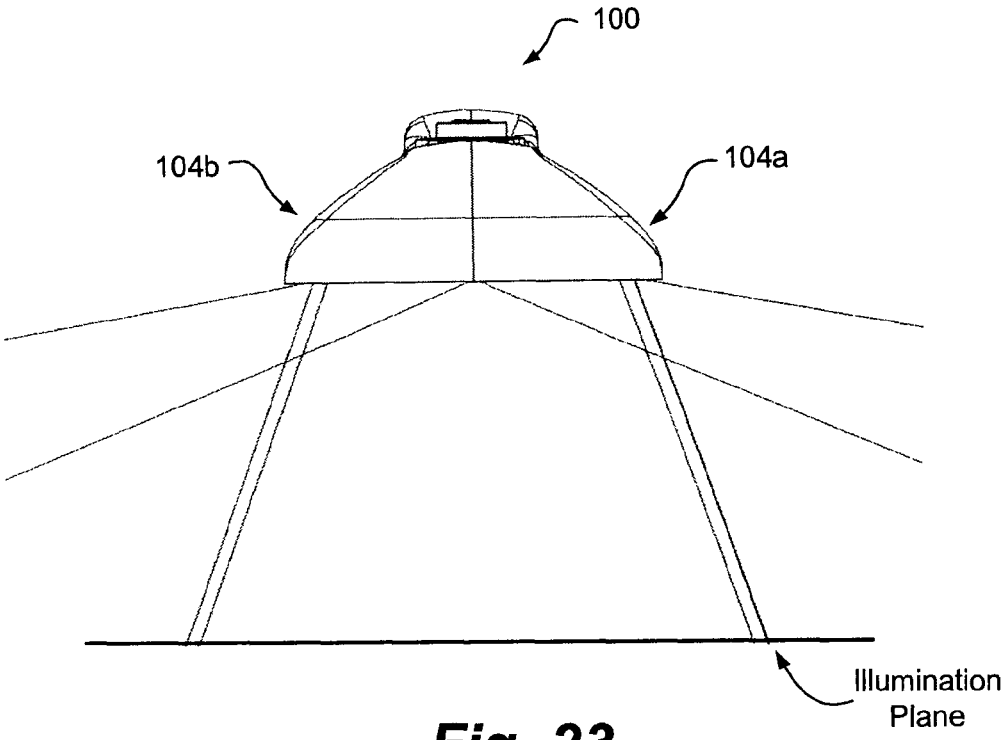
FIG. 23 depicts an illumination pattern of LED light fixture.

The light fixture housing, including the LED sections 104*a*, 104*b* and the mounting surfaces 142*a*, 142*b*, are shaped such that the LED engines 114*a*, 114*b* are angled to face towards a center line of the light fixture (i.e. a vertical plane passing through the center of the light fixture 100 and parallel to the longitudinal axis of the light fixture 100) as well as towards the surface, or plane, being illuminated. As seen in FIG. 23, such an arrangement of the light fixture 100 illuminates the opposite side of the roadway of where the LED engine is located, that is the right LED engine 114*a* faces and illuminates the left side of the road and the left LED engine 114*b* faces and illuminates the right side of the road. By splitting the LED engines 114*a*, 114*b* into two angled LED sections, light can be thrown out in a direction so as to reduce the pole spacing along the illumination plane and achieve the desired light distribution pattern (e.g. IES Type II medium distribution). The LED sections 104*a*, 104*b* and mounting surfaces 142*a*, 142*b* are arranged such that the LED engines 114*a*, 114*b* are angled at approximately 30 degrees from a plane parallel to the plane being illuminated. This angle allows the light output pattern to be achieved with minimal light redirection, for example by reflectors and lenses, that is necessary to perform using the optical components, which increases the optical efficiency of the light fixture 100. In order to produce Type II IES distribution, the LED sections are angled to the road surface and are used in combination with the reflector cups and refractor lens elements over the cups. The tolerances in all cases can be +/−10% of the values stated, for angles and dimensions, in order to provide a light fixture 100 that meets Type II IES illumination patterns, while also maintaining a low weight light fixture that has a small cross section. It will be appreciated that a greater range of values for the angles and dimensions may be used to provide satisfactory results in different situations.

The LED engine angle provides a good compromise between light distribution and fixture height. The light fixture height impacts the weight of the fixture, packaging size and the effective projected area of the fixture. The effective projected area affects the pole class that the fixture can be mounted on and how much stress is imposed on the pole during wind loading.

As described above each side of the light fixture housing has a cooling fin 106 pattern above the LED engine. These cooling fins 106 may be integral to a casting of the light fixture 100. The cooling fins 106 are vertically upright and run perpendicular to a longitudinal axis of the light fixture 100.

Figure 16:
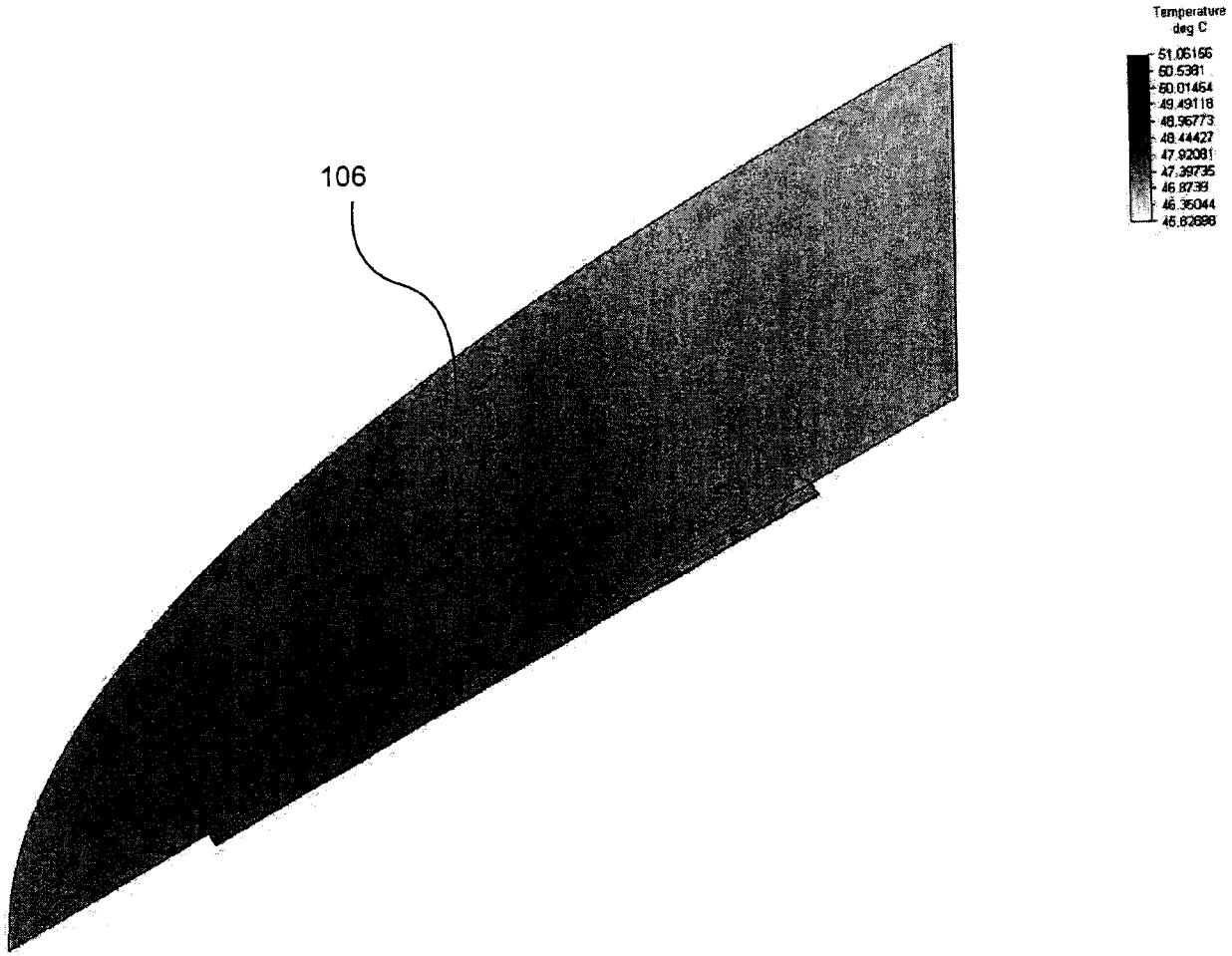
FIG. 16 is thermal model of a fin profile.

FIG. 16 shows a thermal distribution of a profile of a cooling fin 106 of the light fixture 100. The shape of the cooling fins is that of a quarter ellipse that is angled downward at 30 degrees. The surface area of the finned section of the light fixture housing provides convection of the heat emitted from the LED engines 114*a*, 114*b* to the atmosphere that keeps the LED junction temperature less than 40 degrees Celsius above the ambient temperature.

By keeping the cooling fins 106 upright and perpendicular to the longitudinal axis of the light fixture 100, excellent cooling fin gap evacuation, in comparison to a flat finned area or fins running parallel to the longitudinal axis is provided. The curvature of the fins also aids in the curved profile of the light fixture which reduces wind drag in comparison to a flat sided light fixture 100.

Figure 15:
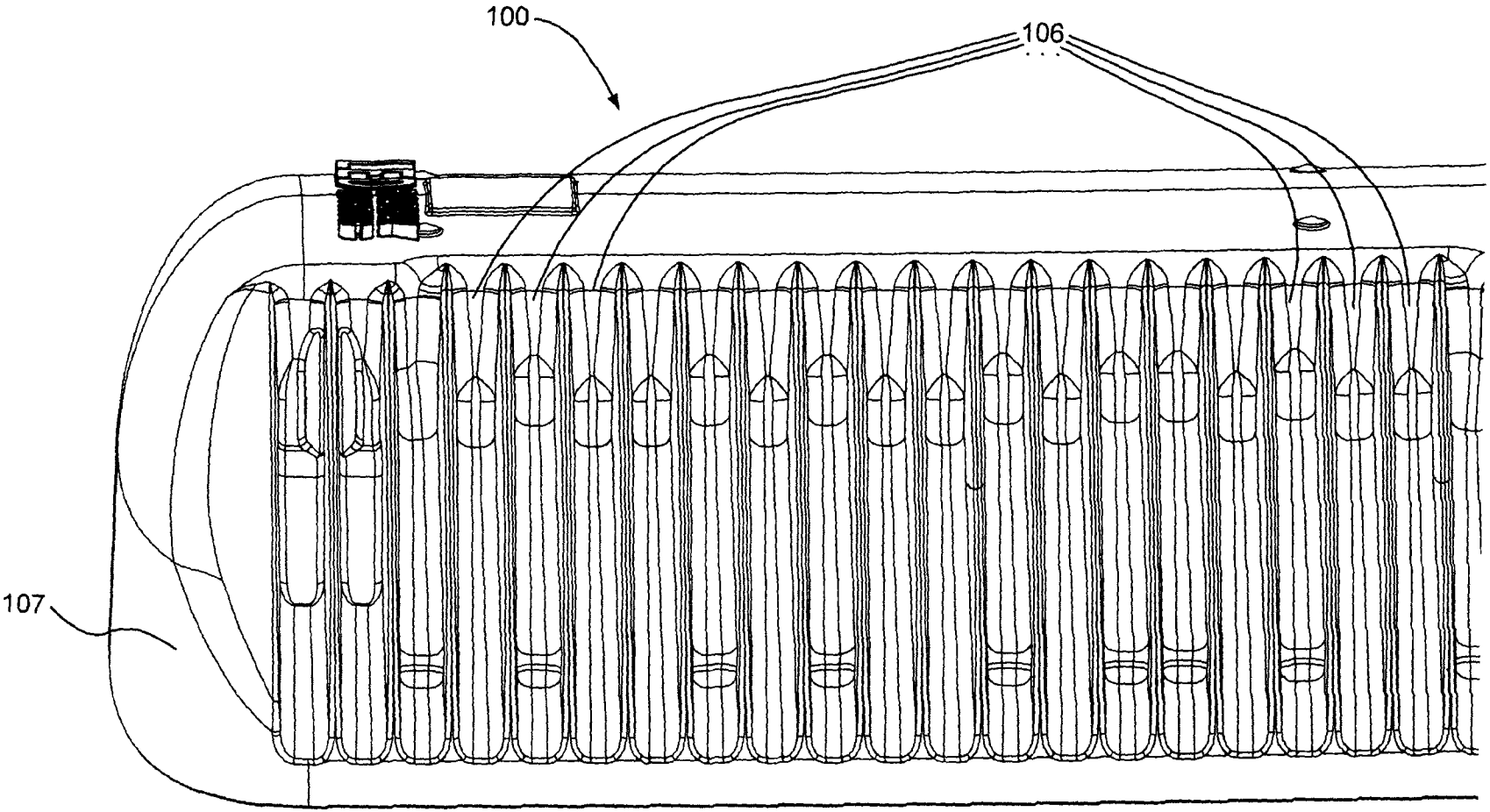
FIG. 15 is a detailed view of the side fin arrangement.
Figure 17:
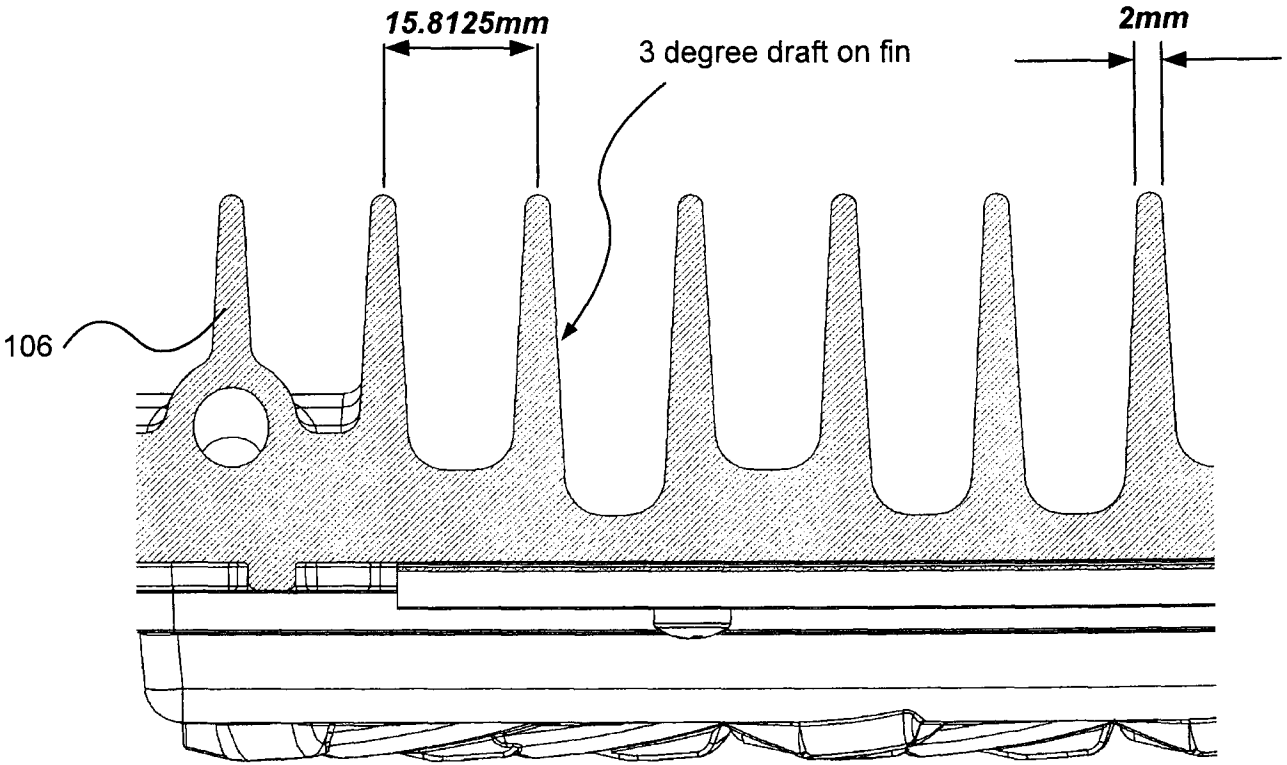
FIG. 17 is a detailed view of fin spacing.

As shown in FIG. 17, each set of cooling fins above the LED sections has, for example, 31 cooling fins 106 above each LED engine as shown in FIG. 15. The spacing of the fins 106 allows a minimum gap of 9.5 mm between the cooling fins which keeps small debris from being caught in this gap. The maximum cooling fin height is about 40 mm in the place where the cooling fin meets the center section 110 of the light fixture housing. This height tapers down to zero at the outboard sides of the LED sections of the light fixture 100. This cooling fins spacing, fin height, and fin profile provides a compromise between thermal performance, low fixture weight, low fixture size and debris evacuation ability. The nominal spacing between the centers of each fin is in the range of between 15.6 mm and 16.0 mm or approximately 15.8 mm as shown in FIG. 17. This spacing allows for an even fin spacing above the LED engines over the length of the light fixture 100 and ensures the gap between the fins is at least 9.5 mm in the narrowest place and allows the fin height to be kept down to 40 mm. Although 31 fins are shown in the drawings the number of fins can be adjusted based upon cooling requirements and overall fixture size and LED engine thermal requirements.

As seen in FIG. 17, the cross sectional shape of each fin is approximately that of a quarter ellipse with a peak height of about 40 mm tapering down to zero at the outboard side of the fixture. The thickness of the fin is approximately 2 mm at the top and drafts outward down to the fin base. 2 mm is the minimum thickness that is generally accepted for a die cast aluminium part of this size. By using this as the minimum fin thickness, weight of the fixture is kept to a minimum.

The LED engines 114*a*, 114*b* are directed toward the centerline of the light fixture 100 and towards the plane being illuminated at a downward angle. The LED engines 114*a*, 114*b* may be angled at 30 degrees from the plane being illuminated. The hottest part of the LED engine 114*a*, 114*b* is near the middle of the engine. Therefore, higher fins are provided in order to heat sink that portion of the LED engine better.

The LED light fixture 100 design is based on an optics model for producing a Type II IES light distribution on a two lane street or roadway. The light fixture is intended to be mounted to a mounting point of a light pole so that the longitudinal axis of the light fixture is perpendicular to the roadway to provide an even light distribution pattern. The drag coefficient of the described light fixture meets specifications for hurricane wind tolerance.

Figure 18A:
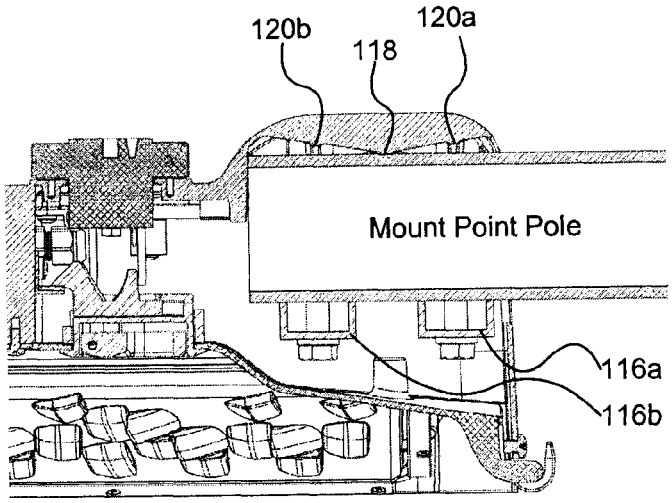
FIG. 18A-C show a pole mounting fixture.
Figure 18B:
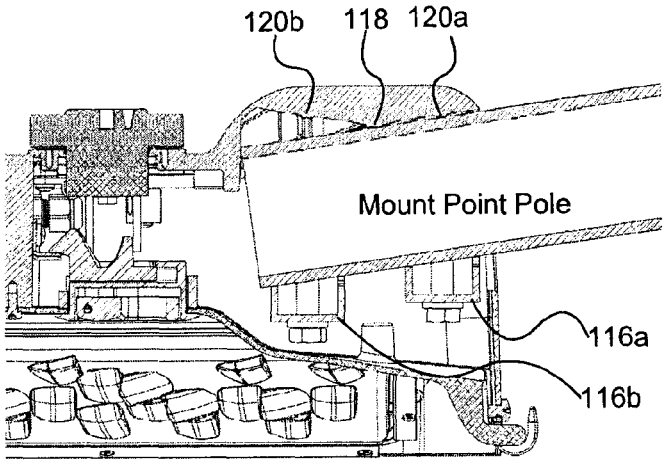
Figure 18C:
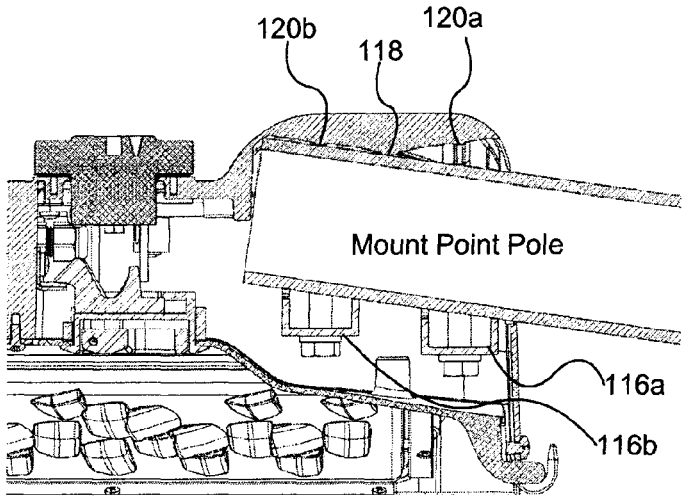
Figure 19:
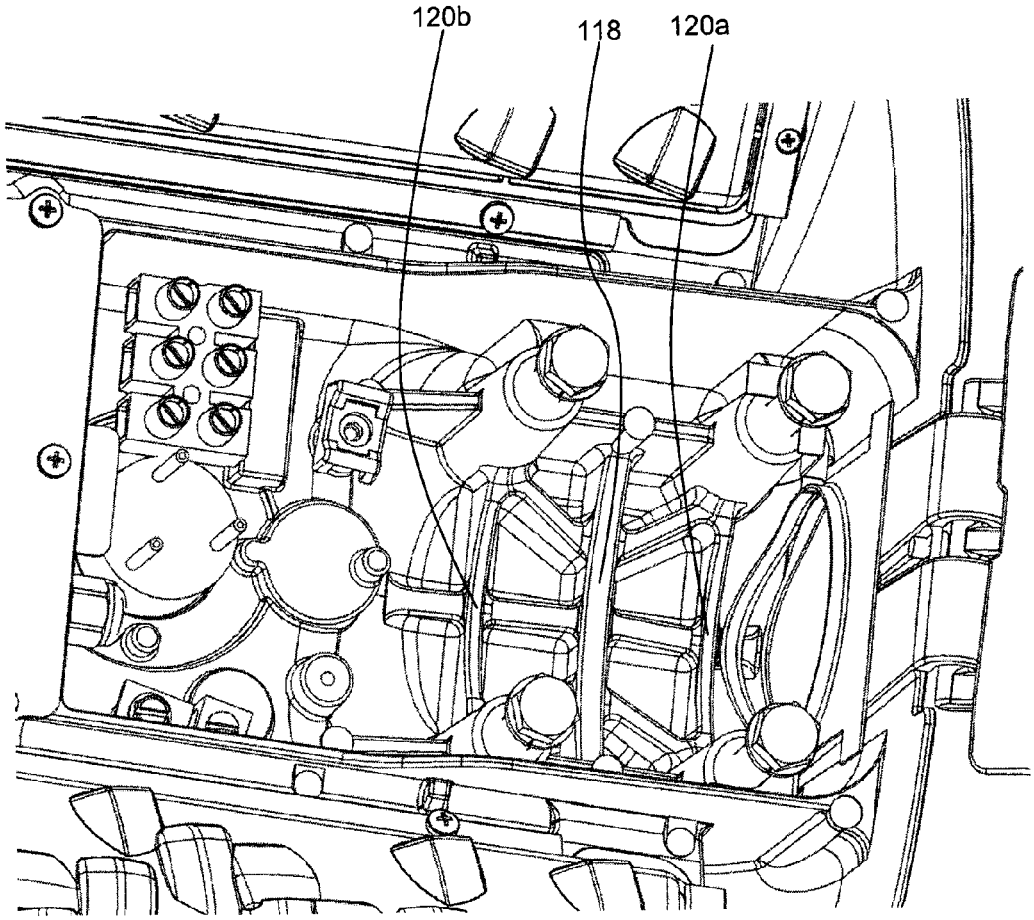
FIG. 19 is a detailed view of the pole mounting compartment.

As shown in FIGS. 18A to 18C, the pole mount feature used to mount the light fixture 100 to the mount point of the light pole consists of integrally cast ribs in the fixture and two pole mount clamps 116*a*,116*b*. There are two holes in each clamp through which pass hex bolts (such as ⅜"-16 hex bolt) with split lock washers on them. These screws fasten into tapped bosses on the fixture. Between each pair of tapped bosses passes a rounded angle stop rib 120*a*, 120*b* that provides a limit for the angle range of the fixture. The radius of curvature the angle stop rib 120*a*, 120*b* is 40 mm and it is 58 mm from the other angle stop rib 120*a*, 120*b*. In the center between the two sets of angle stop ribs 120*a*, 120*b* is another rounded rib 118 that protrudes higher than the other two ribs 120*a*,120*b*. This pivot rib 118 acts as a pivot point for the pole of the mounting point entering the light fixture 100. The radius of curvature of the pivot rib 118 is 80 mm and the low point of this rib is 4 mm above the low point of the angle limit ribs 120*a*,120*b*. The mounting point pole is captured on the side of the pole opposite the ribs by the pole mount clamps 116*a*, 116*b*. The pole mount clamps 116*a*, 116*b* have a rounded cut out section to mate with the pole of the mounting point. This section may also be toothed for added grip on the pole. The angle of the light fixture is adjusted by varying the depth that the bolt is fastened to on each pole mount clamp. The pole of the mount point is secured against the pivot rib 118 and one of the angle stop ribs 120*a*,120*b* by securing the pole mount clamps 116*a*, 116*b*.

The power supply/LED drivers are located in the O-ring sealed front section 110 and are separated from the line connection/pole mount compartment the rear section 112. This enables improved life of the electronics since they are not exposed to the outside environment. It also allows cost savings of putting cases around the LED drivers to seal them since they are in a sealed compartment.

Figure 20:
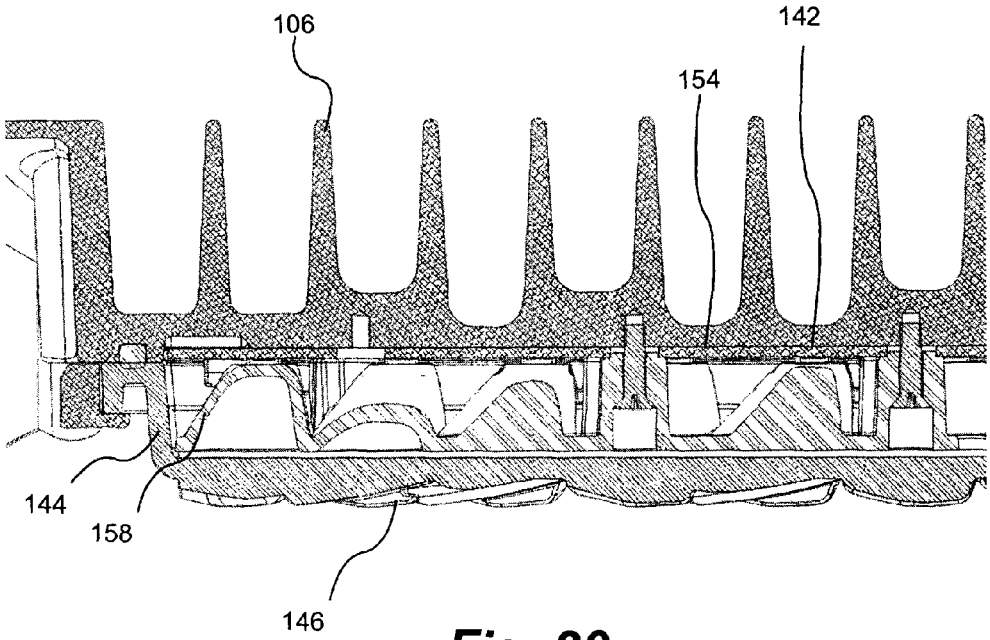
FIG. 20 is cross-sectional view of the LED engine and fin interface.

As shown in FIG. 20, the LED engines 104*a*, 104*b* and reflector module 160 are sealed by an O-ring seal 152 between the clear cover lens 144 and a cover lens rib or groove 150 of the fixture housing. This allows the optical component of the light fixture 100 to be weather proof which prevents contamination of the electronic components contained within, and also prevents debris from degrading the optical transmission through the inside of the cover lens. In addition this enables a consistent optical illumination pattern to be created.

Figure 21:
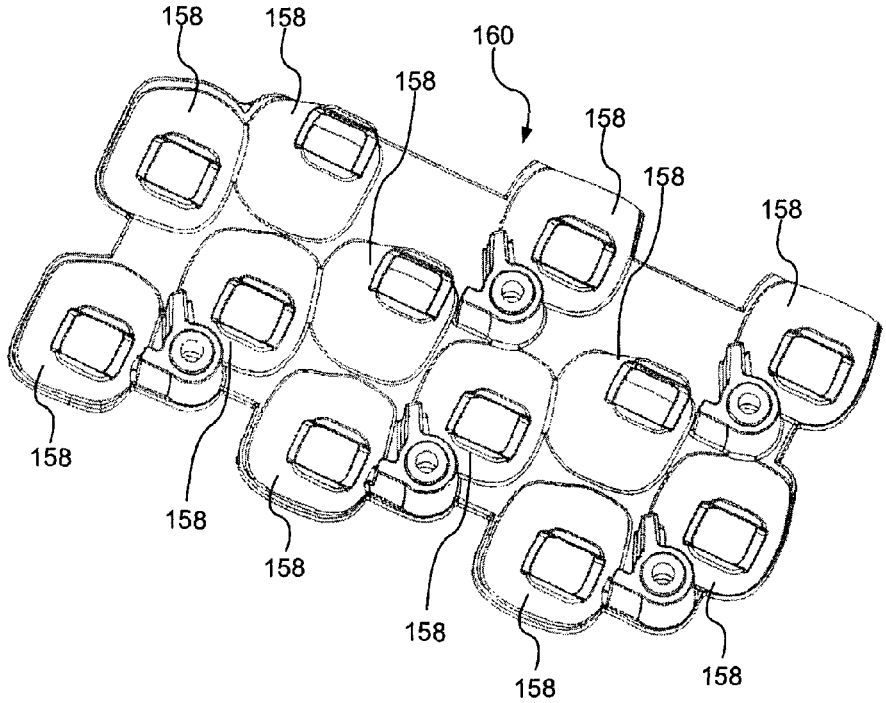
FIG. 21 is top view of a reflector module.

The LED reflector module 160 as shown in FIG. 21 may be located using a tapered head screw in a countersunk hole 164. The base of the reflector mount has a circular boss surrounding the screw hole. This circular feature fits into a through hole on the printed circuit board 154 of the LED engine 114*a*, 114*b*. There is a step in the boss surrounding the screw hole that has an offset face from the bottom surface that rests on the exposed surface of the printed circuit board. When the screw is attached to the light fixture housing this offset face provides pressure to the printed circuit board 154 to provide good contact between it and the fixture housing.

An advantage of this system is that the number of required fasteners is reduced. The same fastener is used to fasten the reflector modules and the PCB board which also frees up printed circuit board space for components and traces. The hole in the PCB is 7 mm in diameter. The screws can be flat head Phillips M3X16 machine screws.

LED's 156 are mounted on aluminium metal core circuit board 154 to promote maximum heat transfer away from the LED's to the fixture housing. Thermally conductive dielectric is used to promote maximum heat transfer away from the LED's to the aluminium base of the circuit board. Highest efficacy LED's are used for maximum light output.

Figure 22:
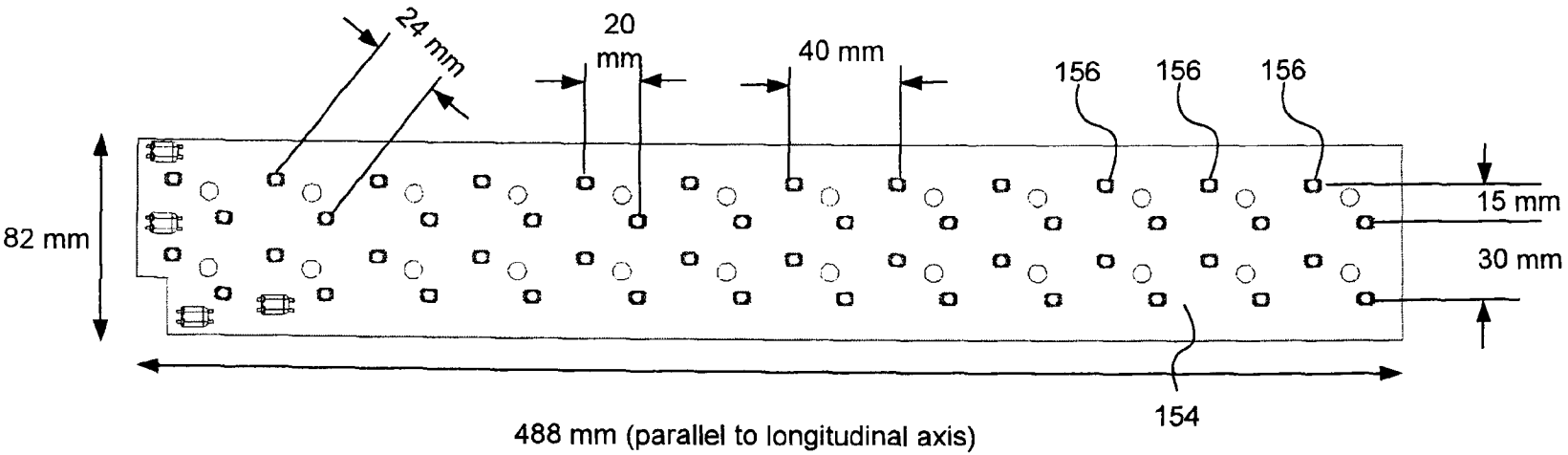
FIG. 22 is LED engine board.

As shown in FIG. 22, LED 156 spacing is 24 mm center to center and is staggered to eliminate cross heating between LED's while keeping the board as compact as possible. On the surface of the circuit board 156, in the direction perpendicular to the longitudinal axis of the light fixture 100, the rows of LED's are spaced 15 mm apart and in the direction parallel to the longitudinal axis of the light fixture 100, the rows of LED's are spaced 20 mm apart. With the staggered pattern the LED's spaced perpendicular to the longitudinal axis are 30 mm apart in that direction from the next LED in that row. The LED's spaced in the direction parallel to the longitudinal axis are 40 mm apart in that direction from the next LED in that row. The circuit board is 488 mm in length by 82 mm in width, although a range of dimensions would be acceptable based upon overall fixture size and compartment size. The LEDs on the circuit board can be populated based upon the desired light output requirements. In addition, smaller sized circuit board could be utilized to provide a modular LED engine similar to the modular reflector module 160. This can allow the LED compartment to be populated with a minimum number of LED engines required to achieve a desired light output.

Copper is left in the spaces between the traces and pads to allow for more thermal mass to remove heat away from LED's. Low profile, surface mount poke-in connectors are used for ease of connection and modularity. Organic Solder Preservative (OSP) finish is used for maximum protection of copper surfaces and best solder adhesion. Boards have stepped mounting holes to serve as locator holes for the optics as well as mounting holes. Pad sizes are optimized for highest level of placement accuracy.

Zener diodes may be paralleled with each LED to provide burnout protection and allow the string to keep operating if an LED should burn out. The Zener voltage is 6.2V so that the Zener does not prematurely turn on from the normal voltage required by the LED's, but low enough to have minimal effect on the voltage of the string if an LED burns out. The Zener is 3 W to be able to handle the power of either 1 W or 2 W LED's and use the power mite package which provides a small foot print and lowest profile. However, we do not see this applied in our competitor's lights. It adds a level of bypass for the current should an LED fail and is a feature that adds performance reliability to the LED light fixture.

It will be apparent to one skilled in the art that numerous modifications and departures from the specific embodiments described herein may be made without departing from the spirit and scope of the present disclosure.

The invention claimed is:

1. An exterior lighting fixture for illuminating a plane, the lighting fixture comprising:

a housing having a longitudinal axis, the housing comprising:

a center section arranged about a longitudinal center line of the housing and running substantially along an entire length of the longitudinal axis of the housing, the center section defining a compartment enclosing at least one light emitting diode (LED) power supply;

a first LED section arranged on a first side of the center section and running substantially along the entire length of the longitudinal axis of the housing, the first LED section defining a first sealable LED compartment and a first mounting surface directed towards the longitudinal center line of the housing and the illumination plane;

a second LED section arranged on a second side of the center section opposite the first side and running substantially along the entire length of the longitudinal axis of the housing, the second LED section defining a second sealable LED compartment and a second mounting surface directed towards the longitudinal center line of the housing and the illumination plane;

a first passageway connecting the sealable center compartment with the first sealable LED compartment; and a second passageway connecting the sealable center compartment with the second sealable LED compartment;

a first LED engine mounted on the first mounting surface of the first LED section, the first LED engine electrically connected to the LED power supply with an electrical cable passing through the first passageway, the first LED engine comprising a plurality of LEDs fixed to a printed circuit board for illuminating a side of the illumination plane; and a second LED engine mounted on the second mounting surface of the second LED, the second LED engine electrically connected to the LED power supply with an electrical cable passing through the second passageway, the second LED engine comprising a plurality of LEDs fixed to a printed circuit board for illuminating a second side of the illumination plane.

2. The exterior lighting fixture as claimed in claim 1, wherein the first and second sealable LED compartments are sealed by a first and second optical covers respectively, the covers sealing the LED engines from exterior elements.

3. The exterior lighting fixture as claimed in claim 1, wherein each of the LED sections are positioned at an angle of approximately 30 degrees to the illumination plane.

4. The exterior lighting fixture as claimed in claim 1, wherein the center section further comprises:

a sealable front section compartment enclosing the LED power supply; and a rear section providing a pole mounting fixture for mounting the exterior lighting fixture to a mounting point of a light pole.

5. The exterior lighting fixture as claimed in claim 4, wherein the rear section further comprises a terminal lug for connecting a mains electrical connection to.

6. The exterior lighting fixture as claimed in claim 4, wherein the pole mounting fixture comprises:

a pivot rib positioned on a bottom surface of the rear section compartment perpendicular to the longitudinal axis, the pivot rib having a predetermined height;

two angle limit ribs positioned on the bottom surface of the rear section compartment perpendicular to the longitudinal axis, each of the angle limit ribs positioned on opposite sides of the pivot rib, each of the two angle ribs having a height lower than the predetermined height of the pivot rib; and two pole clamps for securing the mounting pole to the pivot rib and one of the angle limit ribs, each of the two pole clamps located on opposite sides of the pivot rib.

7. The exterior lighting fixture as claimed in claim 1, wherein the housing further comprises:

a first plurality of cooling fins positioned on an exterior side of the first LED section opposite the first mounting surface, the plurality of fins positioned perpendicular to the longitudinal axis and extending from the center section to an exterior outboard edge of the first LED section; and a second plurality of cooling fins positioned on an exterior side of the second LED section opposite the second mounting surface, the second plurality of fins positioned perpendicular to the longitudinal axis and extending from the center section to an exterior outboard edge of the second LED section.

8. The exterior lighting fixture as claimed in claim 7, wherein the housing includes a top surface defining a convex canopy.

9. The exterior lighting fixture as claimed in claim 8, wherein the convex canopy is defined by the top surface of the center section having an arcuate cross section and a top surface of the first and second set of fins each of the top surfaces descending from the top surface of the center section at an angle of 30 degrees relative to the illumination plane beginning at the center section to an angle of 88 degrees at the exterior edge of the respective center section.

10. The exterior lighting fixture as claimed in claim 7 wherein the maximum fin height is approximately 40 mm where the fins meet the center section which tapers to an exterior outboard edge of the fixture.

11. The exterior lighting fixture as claimed in claim 10 wherein the spacing between the centers of each fin is approximately 15.8 mm.

12. The exterior lighting fixture as claimed in 9, wherein the center section is approximately 125 mm wide and 590 mm long, the arcuate cross section of the center section has a radius of 250 mm.

13. The exterior lighting fixture as claimed in claim 1, wherein the exterior lighting fixture has outside dimensions of approximately 608 mm in length, 350 mm in width and 158 mm in height.

14. The exterior lighting fixture as claimed in claim 7, wherein the first and second set of fins are in contact with the printed circuit board of the respective LED engines.

15. The exterior lighting fixture as claimed in claim 1, further comprising a photocell receptacle for positioning a photocell on the top of the housing.

16. The exterior lighting fixture as claimed in claim 2, wherein a reflector is positioned between the LED's of the printed circuit board and the lens fixtures, each reflector encompasses an individual LED and is associated with an optical element of the lens cover.

17. A housing for an exterior lighting fixture for positioning a plurality of light emitting diodes above an illumination plane, the housing comprising:

a center section arranged about a center line of the housing and running substantially along an entire length of a longitudinal axis of the housing, the center section defining a sealable center compartment for enclosing a light emitting diode (LED) power supply; and first and second LED sections, each of the LED sections located on opposite sides of the center section and running substantially along the entire length of the longitudinal axis of the housing, each of first and second LED sections defining a respective sealable compartment and a mounting surface for mounting an LED engine to the respective LED section covering the sealable compartment, the mounting surface of each respective LED section directed towards the center line of the housing and the illumination plane.

18. The housing as claimed in claim 17, wherein each of the LED sections are positioned at an angle of approximately 30 degrees to the illumination plane.

19. The housing as claimed in claim 17, wherein the sealable center compartment comprises:

a sealable rear section compartment enclosing the LED power supply; and a sealable front section compartment enclosing a pole mounting fixture for mounting the exterior lighting fixture to a mounting pole of a light pole.

20. The housing as claimed in claim 19, wherein the sealable front section further comprises a terminal lug for connecting a mains electrical connection to.

21. The housing as claimed in claim 19, wherein the pole mounting fixture comprises:

a pivot rib positioned on a bottom surface of the sealable front section compartment perpendicular to the longitudinal axis, the pivot rib having a predetermined height;

two angle limit ribs positioned on the bottom surface of the sealable front section compartment perpendicular to the longitudinal axis, each of the angle limit ribs positioned on opposite sides of the pivot rib, each of the two angle ribs having a height lower than the predetermined height of the pivot rib; and two pole clamps for securing the mounting pole to the pivot rib and one of the angle limit ribs, each of the two pole clamps located on opposite sides of the pivot rib.

22. The housing as claimed in claim 17, further comprising:

a first set of cooling fins positioned on a side of the first LED section opposite the first mounting surface, the first set of cooling fins comprising a plurality of fins positioned perpendicular to the longitudinal axis and extending from the center section to an exterior edge of the first LED section; and a second set of cooling fins positioned on a side of the second LED section opposite the second mounting surface, the second set of cooling fins comprising a plurality of fins positioned perpendicular to the longitudinal axis and extending from the center section to an exterior edge of the second LED section.

23. The housing as claimed in claim 22, wherein the housing includes a top surface defining a convex canopy.

24. The housing as claimed in claim 23, wherein the convex canopy is defined by a top surface of the center section having an arcuate cross section and a top surface of the first and second set of fins each of the top surfaces descending from the top surface of the center section at an angle of 30 degrees relative to the illumination plane beginning at the center section to an angle of 88 degrees at the exterior edge of the respective center section.

25. The housing as claimed in 24, wherein the arcuate cross section of the center section has a radius of 250 mm.

26. The housing as claimed in claim 17, wherein the center section is approximately 125 mm wide and 590 mm long.

27. The housing as claimed in claim 17, wherein the housing has outside dimensions of approximately 608 mm in length, 350 mm in width and 158 mm in height.

28. The housing as claimed in claim 17 further comprising first and second passage ways between the center section and the respect LED sections, the passage ways providing a connection pass through between the respective sealable compartments of the LED sections and the LED power supply.

* * * * *